US006640372B2

(12) United States Patent
Ciancimino et al.

(10) Patent No.: US 6,640,372 B2
(45) Date of Patent: Nov. 4, 2003

(54) METHOD AND APPARATUS FOR DETECTING LOAD UNBALANCE IN AN APPLIANCE

(75) Inventors: Rosario Ciancimino, St. Joseph, MI (US); Brenner Martin Sharp, Bridgman, MI (US); Gerald C. Stenger, Mill Creek, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 233 days.

(21) Appl. No.: 09/885,644

(22) Filed: Jun. 20, 2001

(65) Prior Publication Data

US 2001/0054204 A1 Dec. 27, 2001

Related U.S. Application Data

(60) Provisional application No. 60/214,162, filed on Jun. 26, 2000.

(51) Int. Cl.[7] ..... D06F 33/00
(52) U.S. Cl. ..... 8/159; 68/12.06
(58) Field of Search ..... 8/159; 68/12.06

(56) References Cited

U.S. PATENT DOCUMENTS

| | | | | |
|---|---|---|---|---|
| 5,070,565 A | * | 12/1991 | Sood et al. | 8/159 |
| 5,671,494 A | | 9/1997 | Civanelli et al. | 8/159 |
| 5,677,606 A | | 10/1997 | Otake | 318/434 |
| 6,282,965 B1 | * | 9/2001 | French et al. | 73/660 |
| 6,381,791 B1 | * | 5/2002 | French et al. | 8/159 |
| 6,393,918 B2 | * | 5/2002 | French et al. | 73/660 |
| 6,418,581 B1 | * | 7/2002 | Bruce et al. | 8/159 |
| 6,442,979 B1 | * | 9/2002 | Thorn et al. | 68/12.16 |
| 6,564,592 B2 | * | 5/2003 | Bruce et al. | 68/12.06 |
| 2003/0056302 A1 | * | 3/2003 | Broker et al. | 8/159 |

FOREIGN PATENT DOCUMENTS

| | | | |
|---|---|---|---|
| EP | 0 313 339 A1 | 4/1999 | D06F/37/20 |
| FR | 2 630 136 | 10/1989 | D06F/37/20 |

OTHER PUBLICATIONS

European Search Report No. EP 01 11 5278 Dated Jun. 11, 2003.

* cited by examiner

*Primary Examiner*—Randy Gulakowski
*Assistant Examiner*—Joseph Perrin
(74) *Attorney, Agent, or Firm*—Thomas J. Roth; Robert O. Rice; John F. Colligan

(57) ABSTRACT

A method and apparatus for determining load unbalance in an appliance is provided for an appliance having a vessel configured to receive a supply of material and rotatable about an axis. A control is arranged and configured to accelerate a rotation of the vessel between a series of constant rotational speeds, measure an amount of current with which the motor draws in rotating the vessel at each of the rotational speeds and during each acceleration period, compare the amount of current with a calculated threshold value for each speed and each acceleration period and send a signal indicative of an unbalance condition if the amount of energy exceeds the precalculated threshold value. The vessel may be rotated by use of an electric motor such as a controlled induction motor and the control can be used to measure the electric current drawn by the motor. The threshold values can further be adjusted by comparing the actual line voltage supplied to the motor with a predetermined nominal line voltage.

19 Claims, 3 Drawing Sheets

METHOD AND APPARATUS FOR DETECTING LOAD UNBALANCE IN AN APPLIANCE

BACKGROUND OF THE INVENTION

The present invention relates to a method and apparatus for detecting the unbalance condition of a load of material in an appliance and more particularly, for detecting an unbalance condition of a load of material in a rotatable vessel of the appliance.

Various appliances, such as automatic washing machines, automatic dryers, centrifugal liquid extractors, etc., utilize a rotating tub, basket or other vessel holding a load of material which may or may not be evenly distributed within the vessel. The condition of having the load unevenly distributed, or out of balance, creates a situation where the center of mass of the rotating vessel does not correspond to the geometric axis of the vessel. This leads to the generation of high loads and severe vibration of the vessel. In an appliance, this severe vibration may cause the phenomenon of movement of the appliance across the floor or other supporting surface. This can occur both in vertical axis rotating vessels as well as horizontal axis vessels and also in those appliances where the axis is arranged inbetween vertical and horizontal.

Various attempts have been provided in the prior art to provide mechanical arrangements to limit or reduce the possibility of unbalanced loads, which typically involve the addition of various masses, either fixed or movable, to the vessel which requires additional power for the motor to rotate the vessel.

Approaches have also been disclosed in the prior art for detecting a load imbalance, for example, in an inverter driven motor for a washing machine, as disclosed in U.S. Pat. No. 5,070,565. That patent discloses to examine a ripple in the dc-inverter bus current, with a ripple value above a pre-determined level being indicative of load unbalance. If a load unbalance is detected, the washer controller would resume a redistribution cycle to attempt to re-balance the clothes. This would be attempted a predetermined number of times and, if the load is still unbalanced, the spin cycle would be aborted. If the ripple value falls below the predetermined level before the maximum number of tries is reached, the spin cycle is started. Once a spin cycle has been initiated, the length of the spin cycle is determined on the basis of the magnitude of any remaining load unbalance. Spin rate and spin time may be adjusted based upon the degree of load unbalance detected.

It would be an advance if a method and apparatus were provided in which the potential for a severe unbalance could be predicted in advance of it actually occurring so that appropriate steps could be taken to avoid the detrimental effects of such a condition.

SUMMARY OF THE INVENTION

The present invention provides a method and apparatus for detecting a severe unbalance condition in a rotating device such as a basket, tub or other rotatable vessel of an appliance, for example an automatic washer. The method and apparatus provide the detecting by monitoring the motor current signature. When a severe unbalance condition is detected at a high rotational speed, the spin speed can be adaptively dropped down to a safe level, in which the appliance vibrations and mechanical stresses are tolerable. The appliance system can be continuously monitored so that, in the case of an appliance such as an automatic washer, clothes dryer or centrifugal water extraction, as water is extracted from the fabric load, and the load becomes less massive, the spin speed can be gradually increased to a desired level. If too great of an unbalance condition still persists, the spin speed can be adaptably limited or the cycle can be terminated and the user can be advised.

The effect of unbalanced loads in a motor driven rotating component, such as a rotatable vessel, translates into motor torque oscillations, which are proportional to the motor stator currents. Moreover, increased vibrations in certain appliances cause energy dissipation in passive components, such as in the suspension system, causing the average motor current to increase. In the case of a controlled induction motor (CIM), the stator currents are estimated by directly measuring the dc bus current of the inverter.

In the present invention, motor torque oscillations are monitored as the vessel rotational speed is increased in a series of steps and a severe unbalance condition is detected as soon as it happens.

A stepped speed profile is commanded to the motor by the control system in order to obtain information about the load. The average energy that is required by the appliance to spin the vessel is monitored by means of averaging the motor stator current. Under normal conditions, the motor current can increase due to several conditions: acceleration torque due to speed profiles, mechanical drag in the system (i.e., bearings friction, viscous forces, etc.) or energy dissipation by the shock absorbers in the suspension system (i.e., when severe unbalanced loads are present). By carefully choosing the acceleration rates of the speed profiles and using self-referencing techniques, it is possible to minimize the effects of inertia and mechanical drag in the system. It is therefore possible to relate the motor average current to the mechanical dissipation of the shock absorbers and to the unbalance in the load. In a typical speed profile for a spin cycle, several regions can be identified, each characterized by a speed ramp during which the speed is increased, and a plateau where the speed is held constant. The speed ramps should be carefully chosen in order to avoid masking the effect of unbalanced loads on the motor current with the effect of acceleration torque and inertia (i.e., load size). At the beginning of each of these regions, thresholds are dynamically established for the motor current. When the motor current exceeds these thresholds, a severe unbalance condition for the load is assumed. In order to minimize the effect of mechanical drag, a base line for the motor current is acquired at the beginning of each region (end of previous speed plateau). In this condition there is no contribution due to the inertia (speed is constant) and the base line reflects the mechanical drag present in the system. The threshold for the motor current is established as a fixed offset (determined experimentally) above the base line. In order to increase the accuracy of the algorithm, the offset is higher during the speed ramp (to account for higher currents due to acceleration torque) and lower during the speed plateau (no acceleration, only mechanical drag). It is then possible to dynamically create a threshold profile that matches closely the speed profile and that accounts for the system mechanical drag (base line). The thresholds are determined separately for the ramp and for the plateau portions of the spin speed profile.

To further improve the reliability of the algorithm, the thresholds are also adjusted to account for variations in line voltage. The motor current for a given torque-speed operating point depends on the voltage supplied to the motor. When driving the motor with an inverter, the maximum possible voltage is delivered to the motor during parts of the spin speed profile. This maximum voltage applied to the motor depends directly on the line supply voltage provided to the inverter and no regulation for the voltage supplied to the motor is possible in this condition. It has been experimentally determined that when the voltage is low, the current is higher for a given torque-speed point and vice versa. A simple inverse proportional compensation is used to adjust the thresholds to the line voltage.

DETAILED DESCRIPTION OF THE PREFERRED EMBODIMENTS

The present invention relates to a method and apparatus for detecting an out of balance condition in a rotating vessel and has applicability in a wide variety of devices in which materials are placed into a rotatable vessel, which materials may be subject to an unbalanced distribution within the vessel.

For purposes of providing an explanation of the invention in a preferred embodiment, an automatic clothes washer has been identified as an appliance within which the invention can be utilized. It should be understood that the invention can be utilized not only in a vertical axis washer as illustrated, but also horizontal or tilted axis washers, clothes dryers, centrifugal extractors and separators, and other appliances and devices in which a rotatable vessel carries a material therein, which material is subject to being arranged in an unbalanced condition.

Figure 1:
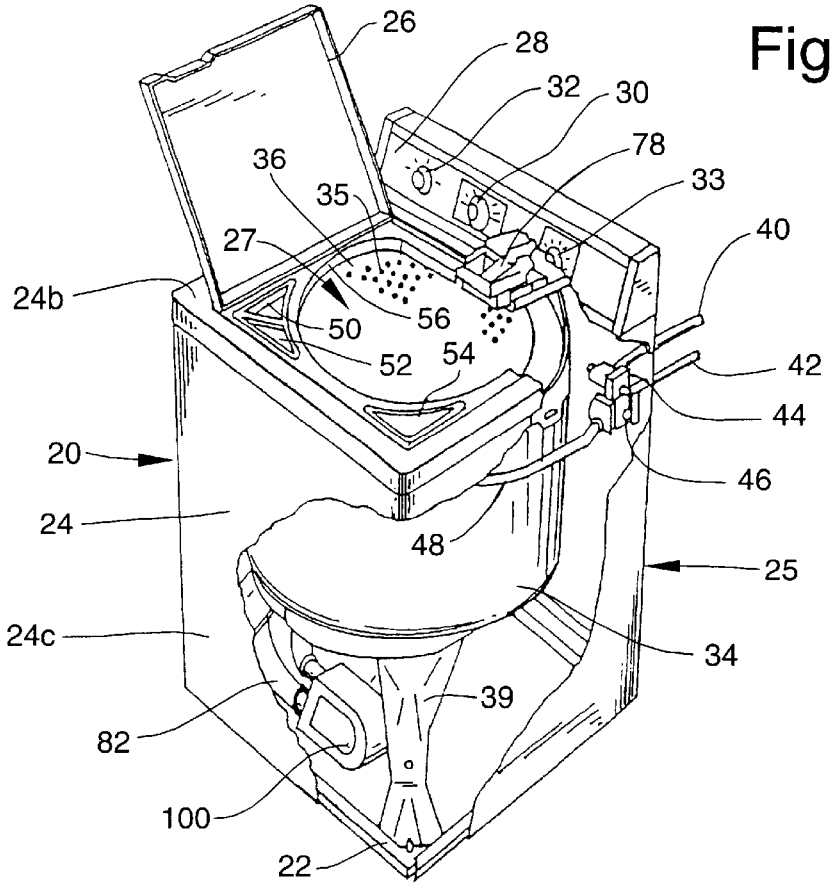
FIG. 1 is a perspective view of an automatic washer in which the present invention could be utilized.

In FIG. 1 there is illustrated at 20 generally a washing machine of the automatic type, i.e., a machine having a pre-settable sequential control apparatus for operating a washer through a pre-selected program of automatic washing, rinsing and drying operations in which the present invention may be embodied. Machine 20 includes a frame 22 carrying vertical panels 24 forming the sides 24*a*, top 24*b*, front 24*c* and back 24*d* of the cabinet 25 for the washing machine 20. A hinged lid 26 is provided in the usual manner to provide access to the interior or treatment zone 27 of the washing machine 20. The washing machine 20 has a console 28 including a timer dial 30 or other timing mechanism and a temperature selector 32 as well as a cycle selector 33 and other selectors as desired.

Internally of the machine 20 described herein by way of exemplification, there is disposed an imperforate fluid containing tub 34 within which there is a spin wash basket 36 with perforations or holes 35 therein, while a pump 38 is provided below the tub 34. The spin basket 36 defines a wash chamber and includes an inside wall surface extending upwardly from a substantially flat bottom. A motor 100 is operatively connected to the basket 36 through a transmission to rotate the basket 36 relative to the stationary tub 34. All of the components inside the cabinet 25 are supported by struts 39 and there may also be provided various passive elements such as shock absorbers or springs to absorb vibrations and movements of the basket and tub relative to the frame and cabinet of the washing machine 20. The basket 36 comprises a vessel into which materials such as a fabric load may be charged.

During the course of operation of an appliance such as an automatic washer, the wash basket 36 is rotated at relatively high speeds in order to extract water or other wash liquids from the clothes load. If the clothes load is not evenly distributed within the wash basket, an unbalance condition occurs which will cause the rotating basket to oscillate around the axis of rotation. Hence there will be some movement of the basket in a direction perpendicular to the axis of rotation. Depending upon the degree of unbalance and the speed of rotation, the oscillation may be small or it may be large enough to actually cause the basket 36 (and tub) 34 to engage the washer cabinet 25 or some other relatively stationary component of the appliance with some level of force. Continued operation in such a mode could cause severe damage to the washer and could cause the entire appliance to move from its otherwise stationary location, which could cause other damage or possibly hazardous conditions in the proximity of the appliance.

The effect of unbalanced loads also causes motor torque oscillations which are proportional to the motor stator currents. Also, increased vibrations cause energy dissipation in passive components of the suspension system, in turn, causing the average motor current to increase. In a motor such as a controlled induction motor, the stator currents are estimated by directly measuring the dc-bus current of the inverter.

The present invention provides a method and apparatus for detecting an unbalance condition in a rotatable vessel as soon as a severe unbalance condition occurs.

Typically an unbalanced condition becomes more severe as rotation speed increases. Therefore, the present method and apparatus contemplate monitoring the motor current after the vessel has been accelerated up to a predetermined minimum speed level which may depend on the particular appliance involved, the mass of its load, etc. However, the speed should be selected based upon a value, below which damage or severe vibration due to load unbalance is unlikely and above which damage or severe vibration could be likely.

Figure 2:
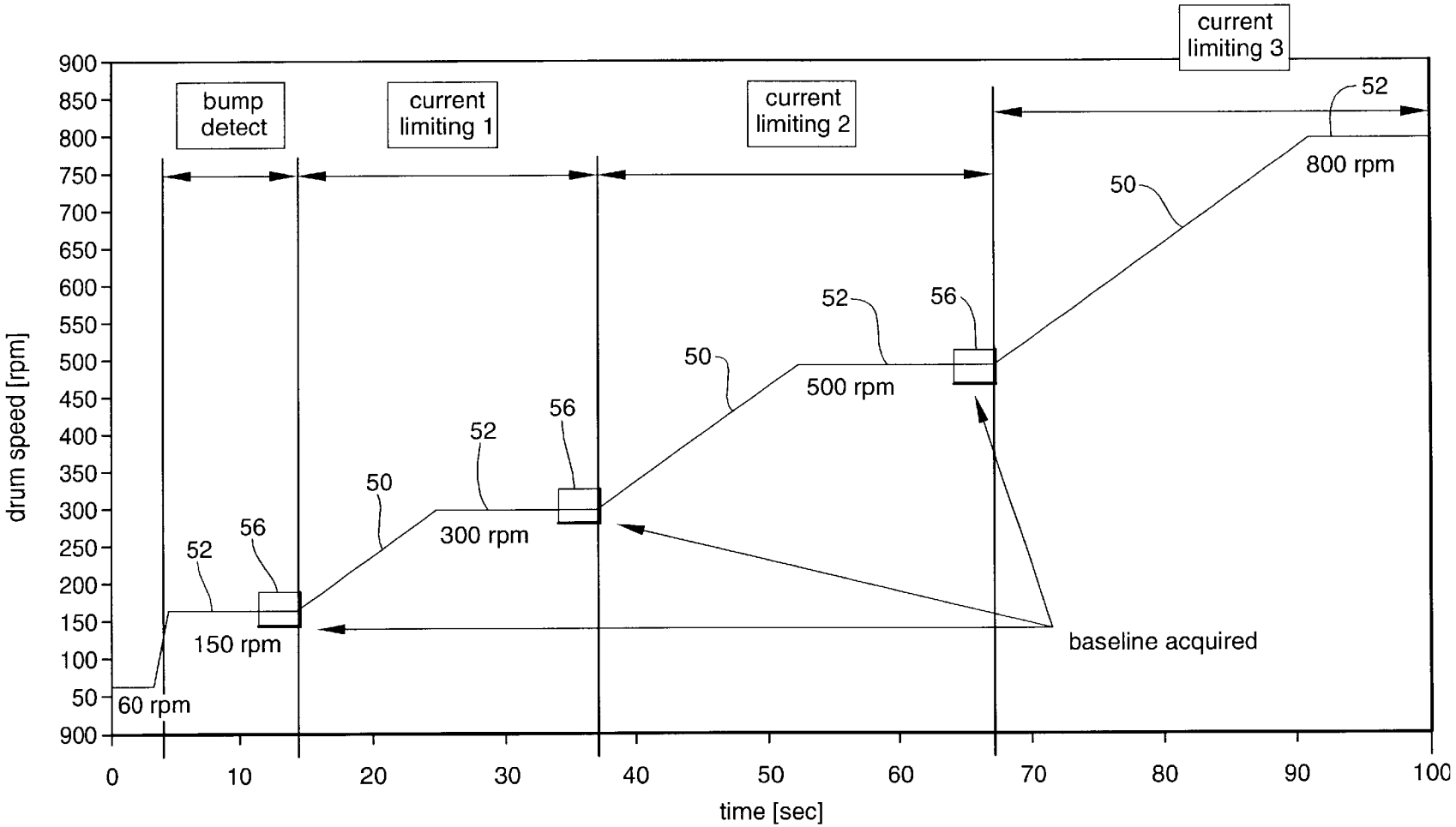
FIG. 2 is a graphic illustration of rotational vessel speed.

FIG. 2 illustrates graphically a spin profile showing rotational speed over time. A series of acceleration periods 50, or speed ramps, as well as a series of plateaus 52 or constant speeds are illustrated.

Figure 3:
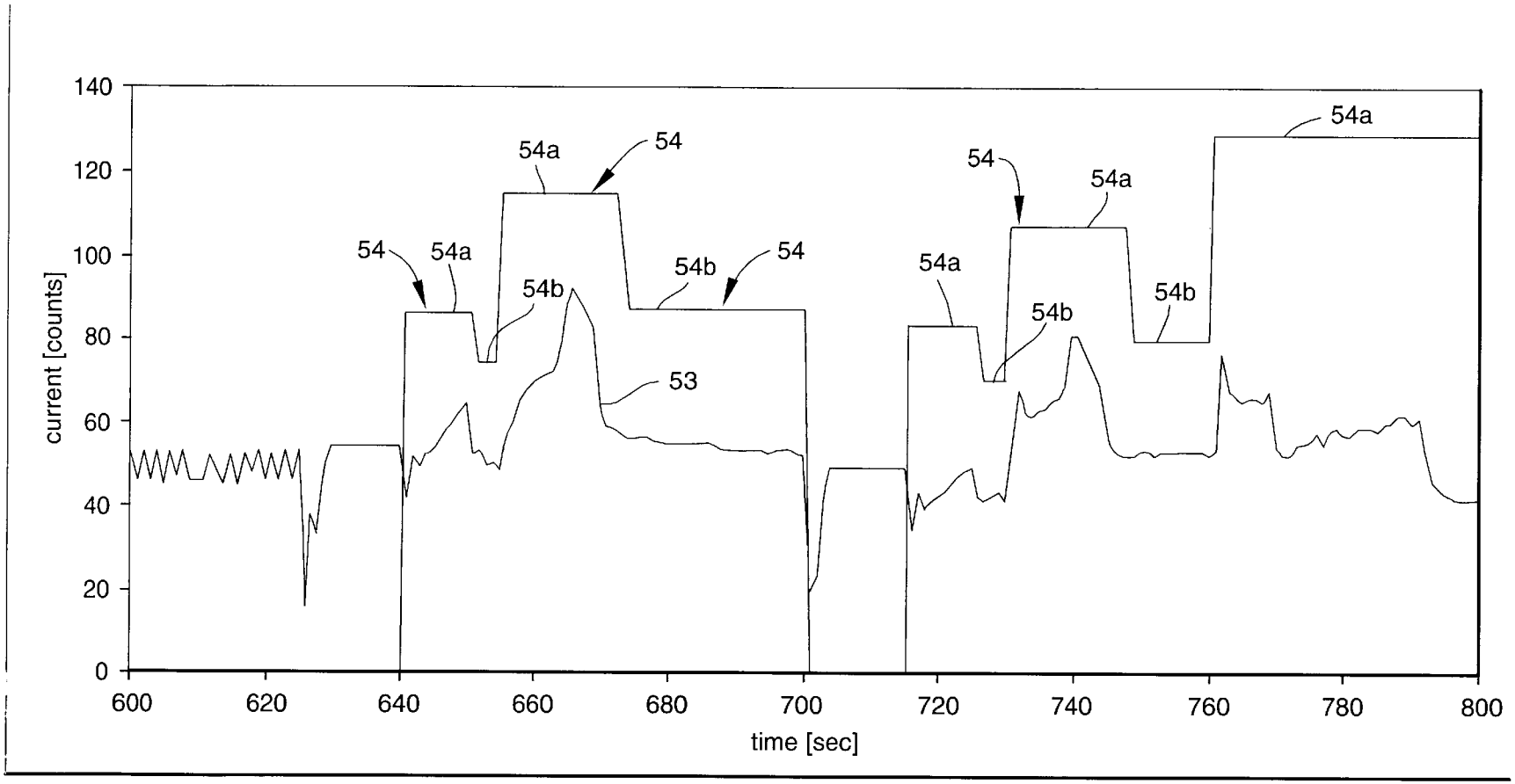
FIG. 3 is a graphic illustration of motor current required to rotate the vessel at different speeds as well as representative thresholds for indicating an unbalance condition.

FIG. 3 illustrates average motor current 53 during acceleration and constant speed modes. FIG. 3 also illustrates a varying threshold level 54 which is determined experimentally as a fixed offset above a base line, separately for each speed ramp and each speed plateau. A base line for the motor current is acquired at the beginning of each region (end of previous speed plateau) as shown at 56 in FIG. 2. In this condition, there is no contribution due to inertia and the base line reflects the mechanical drag present in the system. The threshold value for the motor current is established as a fixed offset (determined experimentally) above the base line. In order to increase the accuracy of the algorithm, the offset is higher during the ramp speed 54*a* to account for higher currents due to acceleration torque and lower during the speed plateau 54*b* where there is no acceleration, only mechanical drag. It is then possible to dynamically create a threshold profile that matches closely to speed profile and that accounts for the system mechanical drag. Also, a predetermined delay period is added following a drop in current demand following an acceleration period before the plateau threshold is implemented to permit the motor current to settle down following an acceleration. This can be seen in FIG. 3 where motor current 53 drops prior to the threshold value dropping from level 54*a* to 54*b*.

The threshold values for ramp and plateau are calculated at the beginning of each new region as follows:

$$\text{Threshold}_{ramp}=\text{base line}+\text{offset}_{ramp}$$

$$\text{Threshold}_{plateau}=\text{baseline}+\text{offset}_{plateau}$$

To further improve the reliability of the algorithm, the thresholds are also adjusted to account for variations in the line voltage. The motor current for a given torque-speed operating point depends on the voltage supplied to the motor. It has been experimentally determined that when the voltage is low the current is higher for a given torque-speed point and visa-versa. A simple inverse proportional compensation is then used to adjust the thresholds to the line voltage.

$$\text{Threshold}_{ramp}=(\text{base line}+\text{offset}_{ramp})\times(\text{voltage}_{nominal}/\text{voltage}_{actual}).$$

$$\text{Threshold}_{plateau}=(\text{base line}+\text{offset}_{plateau})\times(\text{voltage}_{nominal}/\text{voltage}_{actual}).$$

Thus, a standard constant level threshold above the motor current is not utilized, but rather a varying threshold based upon the condition of the rotating vessel, that is whether it is being accelerated or whether it is being rotated at constant speed.

A still more accurate voltage compensation can be implemented, in which a different gain factor is used for voltages above and below nominal:

$$\text{If } (\text{voltage}_{actual}<\text{voltage}_{nominal}) \text{ then Threshold}=(\text{base line}+\text{offset})\times(\text{voltage}_{nominal}/\text{voltage}_{actual})\times\mathbf{K1}.$$

$$\text{Otherwise if } (\text{voltage}_{actual}>\text{voltage}_{nominal}) \text{ then Threshold}=(\text{base line}+\text{offset})\times(\text{voltage}_{nominal}/\text{voltage}_{actual})\times\mathbf{K2}.$$

K1 and K2 are coefficients optimized experimentally.

The precise initial threshold speed, rate of acceleration and speed after each acceleration may be varied, depending on the particular appliance involved, the size or mass of the typical load of material that the vessel is charged with, the severity of unbalance that may be expected, typical final rotational speeds for the vessel, and other parameters known to those skilled in the art. What is important is that the initial threshold rotational speed be chosen so that the speed is not so high as to cause damage to the appliance or damage to the user if an unbalance condition exists.

If an out of balance signal is generated, this could lead to various further steps including a reduction of the spin speed to a lower level at which the appliance vibrations and mechanical stresses are tolerable. The control can continuously monitor the current draw so that as water is extracted from the clothes and load becomes lighter, the spin speed can be gradually increased to a maximum desired value. Alternatively, if the out of balance condition is too severe, the appliance user can be advised by an appropriate visible or audible signal and the cycle stopped until the user manually redistributes the material load and resets the control.

Figure 4:
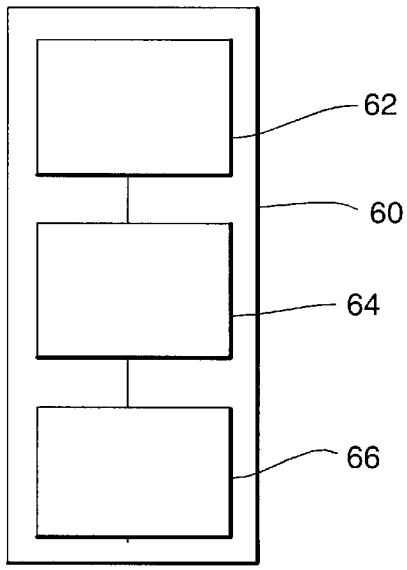
FIG. 4 is a schematic illustration of an appliance embodying the present invention.

Thus, the present invention provides an apparatus as shown schematically in FIG. 4 in which there is an appliance 60 which comprises a vessel 62 mounted for rotation about an axis and configured to receive a supply of material whereby the vessel 62 will vibrate in a severe unbalance loading condition of the material in the vessel while the vessel is rotating. The vessel is caused to rotate by a motor 64 which is operatively connected to the vessel to rotate the vessel.

A control 66 is operatively connected to the motor to operate the motor at various predetermined speeds and to accelerate the motor between those speeds at predetermined rates. A current drawn by the motor at the various speeds and during the accelerations is measured by the control and compared to a pre-calculated threshold at each speed and acceleration period to determine whether the vessel is out of balance. If the threshold for a particular speed or acceleration period is exceeded, the control sends a signal indicative of an unbalance condition which can be used to provide a visible or audible signal to a user or to have the control take further steps to minimize the vibration of the vessel.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an appliance with a vessel for holding a supply of material, said vessel being rotatable by operation of an electric motor, a method comprising the steps:

A. determining an amount of electrical current required by said motor to rotate said vessel at various predetermined speeds and at predetermined acceleration rates between said various predetermined speeds;

B. calculating a separate threshold value above said determined amount of current for each of said predetermined speeds and acceleration rates;

C. charging said vessel with said supply of material;

D. then rotating said vessel about an axis at a first one of said predetermined speeds with said electric motor;

E. then determining an amount of electrical current used by said motor to rotate said vessel at said first predetermined speed;

F. then comparing said amount of electrical current with said calculated value for said first speed;

G. then sending a signal indicative of an unbalance condition if said amount of current exceeds said calculated value;

H. then accelerating said vessel for an acceleration period to a higher predetermined speed if said amount of current is below said calculated value;

I. then determining an amount of electrical current used by said motor to accelerate said vessel to said next higher predetermined speed;

J. then comparing said amount of electrical current with said calculated value for said acceleration period;

K. then sending a signal indicative of an unbalance condition if said amount of current exceeds said calculated value for said acceleration period;

L. then determining an amount of electrical current used by said motor to rotate said vessel at said next higher predetermined speed;

M. then comparing said amount of electrical current with said calculated value for said next higher speed;

N. then sending a signal indicative of an unbalance condition if said amount of current exceeds said calculated value for said next higher speed; and O. repeating steps H through N until either a signal indicative of an unbalance condition is sent or a maximum predetermined speed is achieved.

2. The method of claim 1, wherein said appliance is an automatic washing machine.

3. The method of claim 2, wherein said washing machine is a one of a vertical axis washer a tilt axis washer and a horizontal axis washer.

4. The method of claim 1, wherein said appliance is a clothes treating appliance and said material comprises a fabric load.

5. The method of claim 1, wherein said step of calculating a threshold value for each predetermined speed comprises adding a predetermined value to each determined amount of current at each predetermined speed.

6. The method of claim 5, wherein said step of calculating a threshold value for each acceleration period comprises adding a predetermined value to each determined amount of current at each acceleration period.

7. The method of claim 6, wherein said predetermined value added to achieve a threshold value for each predetermined speed is less than said predetermined value added to achieve a threshold value for each acceleration period.

8. The method of claim 6 including measuring an actual line voltage being supplied to said motor and adjusting the threshold value by compensating for the actual line voltage as compared to a previously determined nominal line voltage.

9. The method of claim 8 wherein said step of adjusting comprises multiplying said threshold value by a quotient of the actual line voltage divided by the nominal line voltage to obtain an adjusted threshold value.

10. The method of claim 9 wherein said step of adjusting further included multiplying the adjusted threshold value by a first constant if the actual line voltage is above the nominal line voltage and by a different constant if the actual line voltage is below the nominal line voltage.

11. A method of controlling operation of an appliance having a vessel for holding a supply of material, said vessel being rotatable by operation of an electric motor, said method comprising the steps:

operating said motor to rotate said vessel at a plurality of increasing predetermined speeds;

accelerating said vessel at predetermined rates between each of said predetermined speeds during an acceleration period;

measuring an amount of current required by said motor to rotate said vessel at each of predetermined speeds and during each of said acceleration period;

comparing said measured current with a separately calculated threshold value for each predetermined speed and acceleration period; and sending a signal indicative of an unbalance condition if said amount of current exceeds said calculated value for any predetermined speed or acceleration period.

12. An appliance comprising:

a vessel mounted for rotation about an axis and configured to receive a supply of material;

an electric motor drivingly connected to said vessel;

a control arranged and configured to operate said motor to rotate said vessel at a plurality of increasing predetermined speeds, to accelerate said vessel to each predetermined speed during an acceleration period to measure an amount of current required by said motor to rotate said vessel at each of said predetermined speeds and during each of said acceleration periods, to compare said measured current with a separately calculated threshold value for each predetermined speed and acceleration period, and send a signal indicative of an unbalance condition if said amount of current exceeds said calculated value for any predetermined speed or acceleration period.

13. An appliance according to claim 12, wherein said appliance is an automatic washing machine.

14. An appliance according to claim 13, wherein said washing machine is one of a vertical axis washer and a horizontal axis washer.

15. An appliance according to claim 12, wherein said appliance is a clothes treating appliance and said material comprises a fabric load.

16. An appliance according to claim 12, wherein said electric motor comprises a controlled induction motor and an inverter is provided in the control connected to the motor, said control further comprising a current measuring device connected to a dc bus of said inverter.

17. An appliance according to claim 16, wherein said current measuring device provides an output signal representative of the current used by said motor, said control further including a digital filter connected to receive said output signal, said digital filter including a running average algorithm and providing an output representative of an average current used by said motor.

18. An appliance according to claim 12, wherein said signal comprises one of an audible and visible signal to a user.

19. An appliance according to claim 12, wherein said signal comprises an electrical signal transmitted to a further part of said control.

* * * * *